United States Patent [19]

Maruyama et al.

[11] Patent Number: 4,866,337

[45] Date of Patent: Sep. 12, 1989

[54] IMAGE PICK-UP TUBE WITH ELECTROSTATIC DEFLECTING ELECTRODE STRUCTURE

[75] Inventors: Masanori Maruyama, Tokorozawa; Kentaro Oku, Kokubunji; Masakazu Fukushima, Tokyo; Shinichi Kato, Mobara; Mitsuhiro Kurashige, Tachikawa, all of Japan

[73] Assignees: Hitachi, Ltd.; Nippon Hoso Kyokai, both of Tokyo, Japan

[21] Appl. No.: 15,378

[22] Filed: Feb. 17, 1987

[30] Foreign Application Priority Data

Mar. 5, 1986 [JP] Japan ..... 61-46214

[51] Int. Cl.[4] ..... H01J 29/74; H01J 29/78

[52] U.S. Cl. ..... 313/432; 313/434; 313/435; 313/439; 313/390

[58] Field of Search ..... 313/432, 421, 433, 434, 313/435, 436, 437, 439, 390

[56] References Cited

U.S. PATENT DOCUMENTS

| | | | |
|---|---|---|---|
| 3,666,985 | 5/1972 | Schlesinger | 315/382.1 |
| 3,796,910 | 3/1974 | Ritz, Jr. | 313/433 X |
| 4,663,560 | 5/1987 | Oku et al. | 313/432 X |

FOREIGN PATENT DOCUMENTS

| | | | |
|---|---|---|---|
| 220340 | 12/1983 | Japan | 313/432 |
| 127349 | 7/1984 | Japan | 313/390 |

*Primary Examiner*—Donald J. Yusko
*Assistant Examiner*—Michael Horabik
*Attorney, Agent, or Firm*—Antonelli, Terry & Wands

[57] ABSTRACT

In an electromagnetic focusing electrostatic type image pick-up tube the electrostatic deflecting electrodes formed on the inner surface of the tube consist of 2 pairs of electrodes. Each of these electrostatic deflecting electrodes has a zig-zag shape from the electron gun towards the target. This zig-zag shape is twisted in the circumferential direction around the axis of the tube and variation rates of this twist amount are different, depending on the position in the axial direction.

22 Claims, 7 Drawing Sheets

IMAGE PICK-UP TUBE WITH ELECTROSTATIC DEFLECTING ELECTRODE STRUCTURE

BACKGROUND OF THE INVENTION

1. Field of the Invention

This invention relates to an image pick-up tube used for a television camera, etc., and in particular to the structure of electrostatic deflecting electrodes in a magnetic focusing and electrostatic deflecting (hereinbelow abbreviated to MS) image pick-up tube.

2. Description of the Related Art

In an MS image pick-up tube proposed heretofore an electro-magnetic coil disposed so as to surround its vacuum envelope (glass tube) focuses an electron beam and two pairs of electrostatic deflecting electrodes formed on the inner surface of the glass tube deflect the electron beam.

FIG. 1 is a cross-sectional view illustrating the construction of a prior art MS image pick-up tube. An electron gun 7 consisting of a cathode 71, a first grid 72, a second grid 73 and an adsorption electrode 74 for return electron beam is disposed at one end within the glass tube. On the second grid 73 is formed a beam disk electrode having an extremely small aperture for forming a fine electron beam. The electron gun 7 generates the electron beam 8. At the other end of the glass tube 1 are arranged a photoconductive target 3 scanned with the electron beam 8 and a mesh electrode 4. This target 3 is disposed on a face plate 2. On the inner surface of the glass tube 1 are formed electrostatic deflecting electrodes 5 generating deflecting electric fields in order to scan the target 3 in the horizontal and vertical directions with the electron beam 8. A focusing coil 6 generating a focusing magnetic field for focusing the electron beam 8 on the surface of the target 3 is disposed on the outer periphery of the glass tube 1 so as to surround the glass tube 1. A cylindrical electrode 9 is disposed between the mesh electrode 4 and the deflecting electrodes 5. The mesh electrode 4 and the cylindrical electrode 9 are connected with each other so that they are at a same potential. The potential difference between the cylindrical electrode 9 and the deflecting electrodes 5 constitutes an electrostatic lens. This electrostatic lens is called a collimating lens and acts so as to remove radial landing errors of the electron beam deflected by the deflecting electrodes 5. Further the mesh electrode 4 forms a decelerating electric field between the target 3 and the mesh electrode 4 and enables the scanning with a low-speed electron beam.

The deflecting electrodes 5 are formed by depositing a conductive film by vacuum evaporation on the inner surface of the glass tube and cutting it e.g. by means of a laser beam into 4 zig-zag patterns separated from each other. These deflecting electrodes 5 are called pattern yokes. FIG. 2A is a development scheme of the pattern yokes seen from the inside of the glass tube 1. Such a zig-zag shaped pattern yoke is disclosed in U.S. Pat. No. 2,830,228 to Schlesinger. FIG. 2B is a scheme illustrating these pattern yokes seen from the target 3 of the glass tube 1, where the thickness of the electrodes is neglected. The line $\overline{B_1B_2}$ connecting the upper apices M of a zig-zag shape of the pattern yokes in FIG. 2A is in the form of a spiral extending from one end to the other end of the pattern yokes on the inner surface of the glass tube, while rotating around the center axis O of the glass tube. The rotation angle of this line $\overline{B_1B_2}$, i.e. the center angle $<B_1OB_2$ formed by the lines $OB_1$ and $OB_2$ in FIG. 2B connecting the points $B_1$ and $B_2$, respectively, where the two ends of the pattern yokes intercept the line $\overline{B_1B_2}$, with the axis O of the tube is called twist angle and designated by $\omega$. In the example illustrated in the figure the twist angle $\omega$ is equal to 180°. The ordinate of FIG. 2A represents the twist angle measured from the point $A_1$, $A_2$. It is disclosed in U.S. Pat. No. 3,666,985 to Schlesinger that the pattern yokes have a certain twist angle $\omega$. The pitch between two adjacent upper apices of the zig-zag shape of the pattern yokes is designated by L and the number of repetitions by n. Then the total length of the pattern yokes is nL.

Among the pattern yokes the electrodes $H^+$ and $H^-$ are horizontal deflecting electrodes, to which horizontal deflecting voltages $+V_H/2$ and $-V_H/2$, respectively, superposed on a bias voltage $E_{C3}$ are applied, forming a deflecting electric field in the horizontal direction. The electrodes $V^+$ and $V^-$ are vertical deflecting electrodes, to which vertical deflecting voltages $+V_V/2$ and $-V_V/2$, respectively, superposed on the bias voltage $E_{C3}$, forming a deflecting electric field in the vertical direction.

It is disclosed in U.S. Pat. No. 4,663,560 granted May 5, 1987, that in such an image pick-up tube the most suitable twist angle of the pattern yokes is 30° for the purpose of increasing remarkably the uniformity of the resolution. The twist angle is disclosed as being uniform along the axis of the tube.

Further, it has been known that such an MS image pick-up tube can be used under a condition where the voltage applied to the mesh electrode is higher with a larger twist angle. When the voltage applied to the mesh electrode is high, beam bending can be small. Beam bending refers to a phenomenon where the trajectory of the electron beam is bent towards clear parts on the target 3 on which an optical image is projected, thereby producing local distortions of the image and lowering of the resolution. Consequently it is desirable to use twisted pattern yokes in order to ameliorate the uniformity of the resolution or to reduce the beam bending. However, even if these means are used, in an MS image pick-up tube having high resolution characteristics owing to a high voltage applied to the mesh electrode, the potential difference between the mesh electrode and the deflection electrodes cannot be increased significantly because of the strength of the collimating lens constituted by the potential difference therebetween. There are also limits in lowering the DC voltages applied to the deflecting electrodes and in reducing focusing electric power or deflecting electric power.

SUMMARY OF THE INVENTION

The object of this invention is to provide an MS image pick-up tube providing a reduction in the electric power consumption by lowering the DC voltage applied to the deflecting electrodes without degrading beam deflection characteristics.

In order to achieve this object, in an electromagnetic focusing.electrostatic deflecting (MS) type image pick-up tube having zig-zag shaped electrostatic deflecting electrodes according to this invention, the deflecting electrodes are twisted in the circumferential direction and the twist has different variation rates, depending along the position on the axis of the tube.

According to this invention it is possible to obtain excellent deflected beam characteristics and at the same time to provide an MS image pick-up tube of low electric power consumption.

These and other objects and many of the attendant advantages of this invention will be readily appreciated from the following detailed description when considered in connection with the accompanying drawings.

DESCRIPTION OF THE PREFERRED EMBODIMENTS

Figure 1:
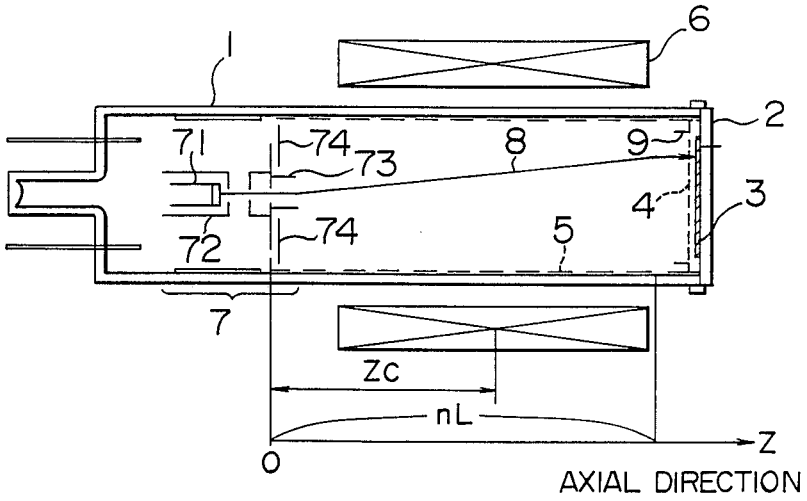
FIG. 1 is a schematical cross-sectional view of an MS image pick-up tube to which this invention is applied.

Hereinbelow an embodiment of this invention will be explained, referring to the drawings.

Figure 2A:
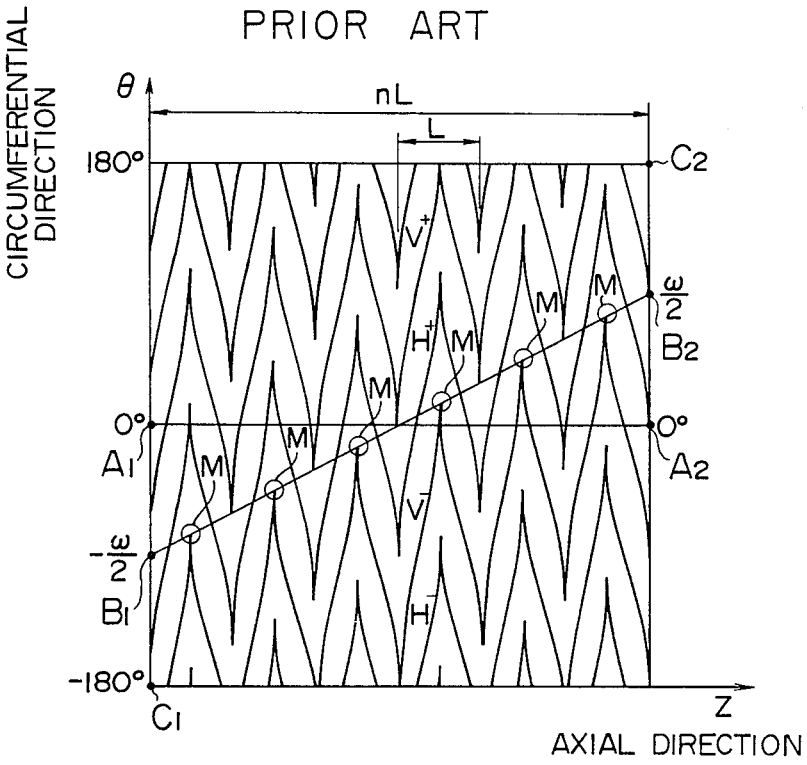
FIG. 2A PRIOR ART
FIG. 2A is a developed view laid in a plane of prior art deflecting electrodes as seen from the inside of the glass tube.
Figure 2B:
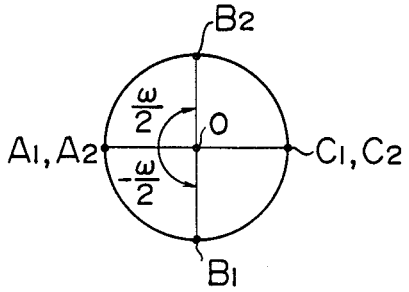
FIG. 2B PRIOR ART
FIG. 2B is a diagram illustrating the deflecting electrodes indicated in FIG. 2A, as seen from the electron gun and of the pick-up tube.
Figure 3:
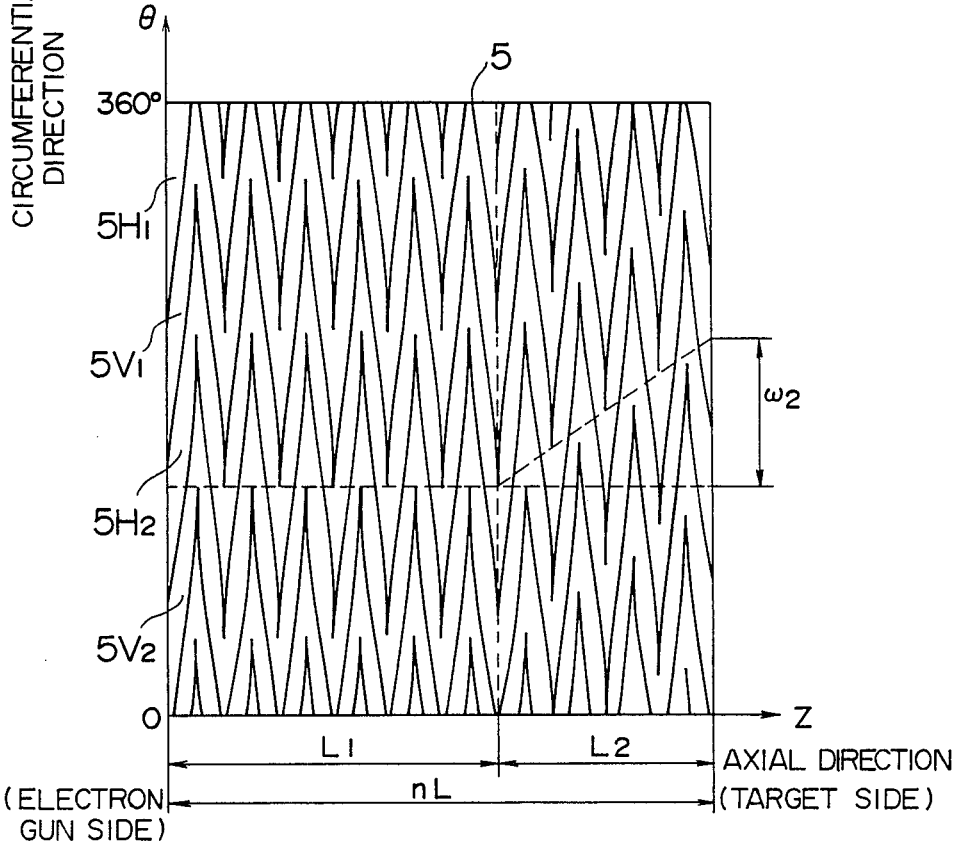
FIG. 3 is a developed view similar to FIG. 2A illustrating the deflecting electrodes according to an embodiment of this invention.

FIG. 3 is a development scheme illustrating deflecting electrodes of an MS image pick-up tube, which is an embodiment of this invention. The deflecting electrodes 5 consist of horizontal deflecting electrodes $5H_1$, $5H_2$ and vertical deflecting electrodes $5V_1$, $5V_2$. The deflecting electrodes 5 according to this embodiment are twisted in the circumferential direction around the axis O of the tube only on a part (part $L_2$ long). That is, the deflecting electrodes 5 consist of a first region ($L_1$ long in the axial direction), which is on the side of the electron gun 7, and a second region ($L_2$ long). The twist angles in the different regions differ from each other. In the first region $L_1$ there is no twist (twist angle $\omega_1=0$), and in the second region $L_2$ a positive twist (twist angle $\omega_2$) in the circumferential direction is applied to the deflecting electrodes 5. Thus, the variation rates of the twist angle, i.e. the twist angle per unit length along the axis of the tube, on both sides of the boundary between the first region $L_1$ and the second region $L_2$ differ from each other. The polarity of the twist angle applied to the deflecting electrodes 5 is positive, i.e. in the same helical direction as the direction of the magnetic field produced by a focusing coil 6. The twist direction is counterclockwise as viewed exteriorly of the tube from the target end of the pick-up tube. The appearance of the twist when viewed from the exterior of the tube is the reverse of the appearance of the twist from the inside of the tube which is what is illustrated in FIGS. 2A, 3, 6, 8 and 9.

Figure 4A:
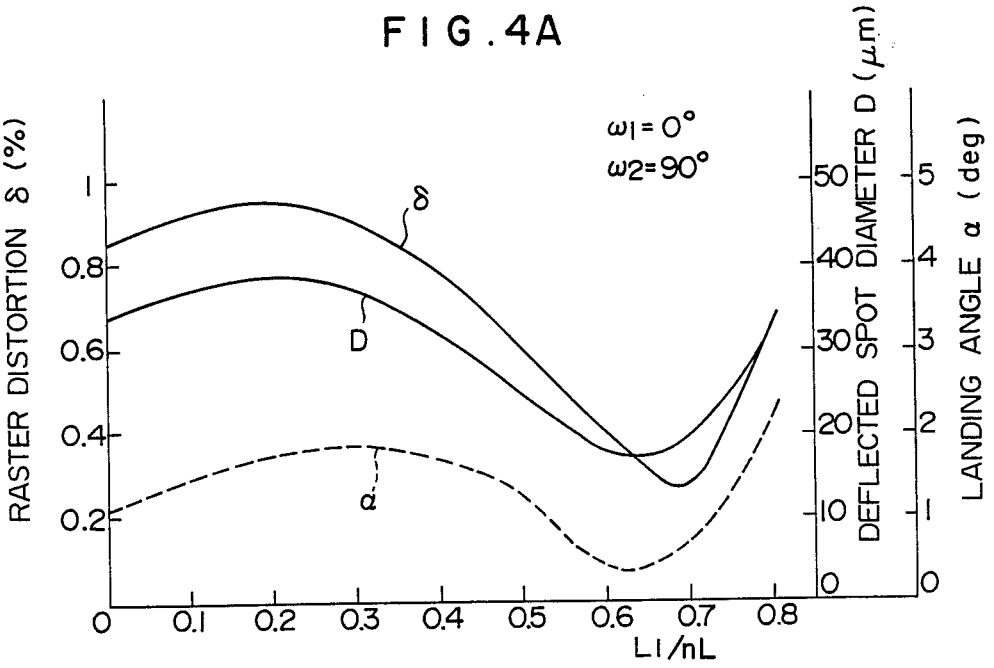
FIGS. 4A, 4B, 4C and 5 are graphs showing deflection characteristics in the embodiment illustrated in FIG. 3.
Figure 4B:
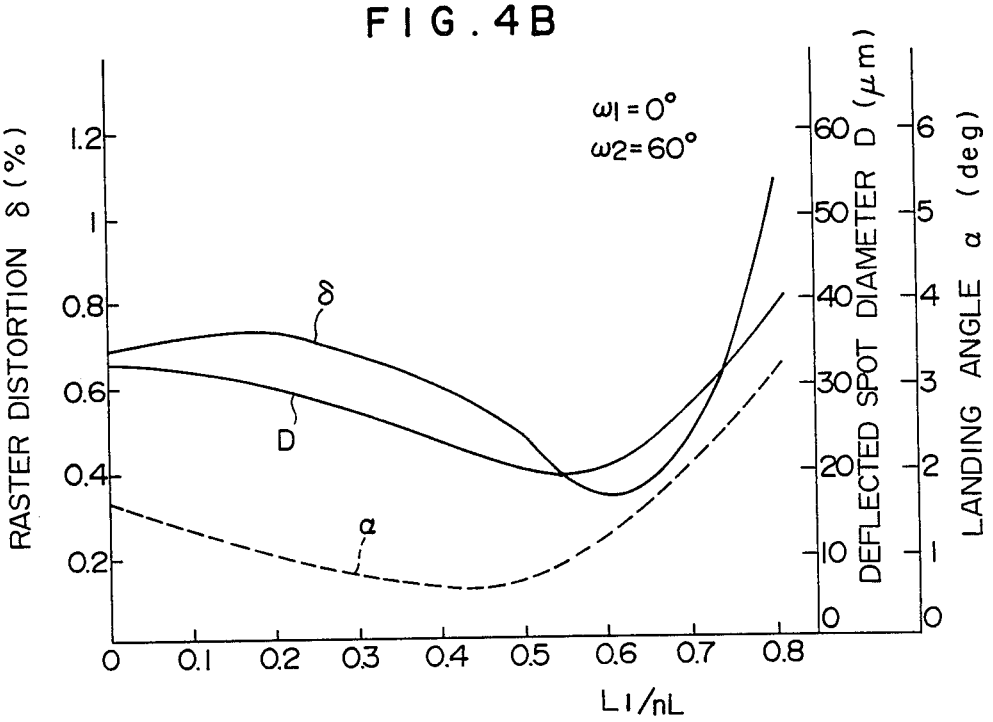
Figure 4C:
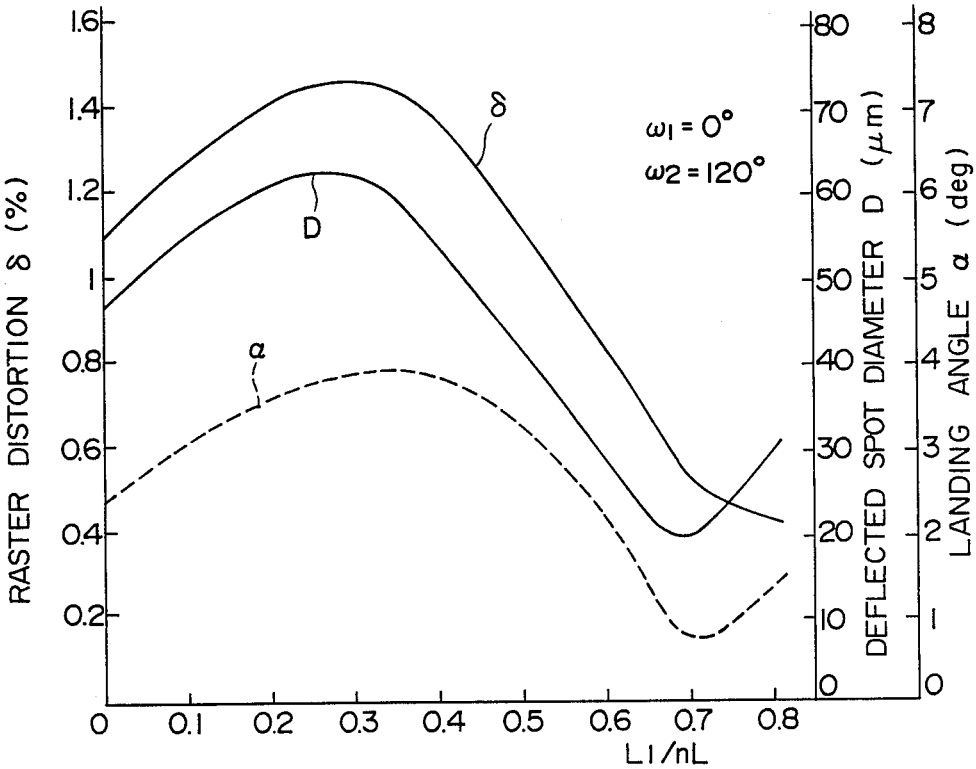

FIGS. 4A, 4B and 4C indicate beam characteristics at the deflection for $\omega_1=0°$, $\omega_2=90°$; $\omega_1=0°$, $\omega_2=60°$ and $\omega_1=0°$, $\omega_2=120°$, respectively, in the case where the deflecting electrodes 5 in the embodiment indicated in FIG. 3 are used. The abscissa represents the ratio of the length $L_1$ of the first region to the total length nL, indicating the division of the length into the first and the second region. The deflected beam characteristics are determined by the raster distortion $\delta$, the deflected spot diameter D and the beam landing angle $\alpha$ relative to the mesh electrode. The deflected spot diameter D represents the greatest diameter of a spot produced on the target by a group of electrons emitted at a position on the axis in an extremely small aperture of the electron gun with a half angle of 1°. For measurements of these characteristics a ⅔ inch-sized image pick-up tube having a raster region of 6.6×8.8 mm was used. The dimensions of the construction of this image pick-up tube and the voltages applied to the various electrodes will be described below. The diameter of the deflecting electrodes is 16 mm; the total length thereof nL (the number n of pitches of the pattern being 10) is 45 mm; the length of the focusing coil is 39 mm; the center position $Z_C$ of the coil is 26 mm; the voltage $E_{C2}$ applied to the extremely small aperture (second grid) is 105 V; the voltage $E_{C4}$ applied to the mesh electrode is 340 V; and the DC voltage $E_{C3}$ applied to the deflecting electrodes is set to 105 V; which is lower than about 40% of the voltage $E_{C4}$ applied to the mesh electrode. The twist angle in the first region $L_1$ of the deflecting electrodes is set to $\omega_1=0$ and the twist angle in the second region is $\omega_2=90°$ for FIG. 4A, $\omega_2=60°$ for FIG. 4B and $\omega_2=120°$ for FIG. 4C.

The prior art techniques indicated in FIG. 2A correspond to $L_1/nL=0$. For example, in the case of $\omega_2=90°$ indicated in FIG. 4A, the landing angle $\alpha$ is as small as about 1°. However the raster distortion $\delta$ is 0.85% and the deflected spot diameter D is 33 μm. That is, both of them are large. Taking these values into consideration, it can be understood that, in a system where the DC voltage applied to the deflecting electrodes 5 is reduced, according to the prior art techniques it is not possible to obtain satisfactory deflected beam characteristics. To the contrary, according to this embodiment, e.g. in FIG. 4A where $\omega_2=90°$, supposing that $L_1/nL=0.6$ (i.e. the zig-zag shaped electrodes have $n_1=6$ pitches for $L_1$ and $n_2=4$ pitches for $L_2$), the landing angle $\alpha$ is 0.5°; the raster distortion $\delta$ is 0.41%; and the deflected spot diameter is 18 μm. All these values are remarkably better than those obtained by the prior art techniques. All described above are valid also for FIG. 4B ($\omega_2=60°$) and FIG. 4C ($\omega_2=120°$).

As clearly seen from FIGS. 4A, 4B and 4C, when the twist angle varies, $L_1/nL$, for which the landing angle $\alpha$ is smallest, varies also. However it can be understood on the basis of the characteristics for the raster distortion and the deflected spot diameter that $L_1/nL=0.5$ to 0.7 is suitable for a region of $\omega_2=60°$ to 120°.

Figure 5:
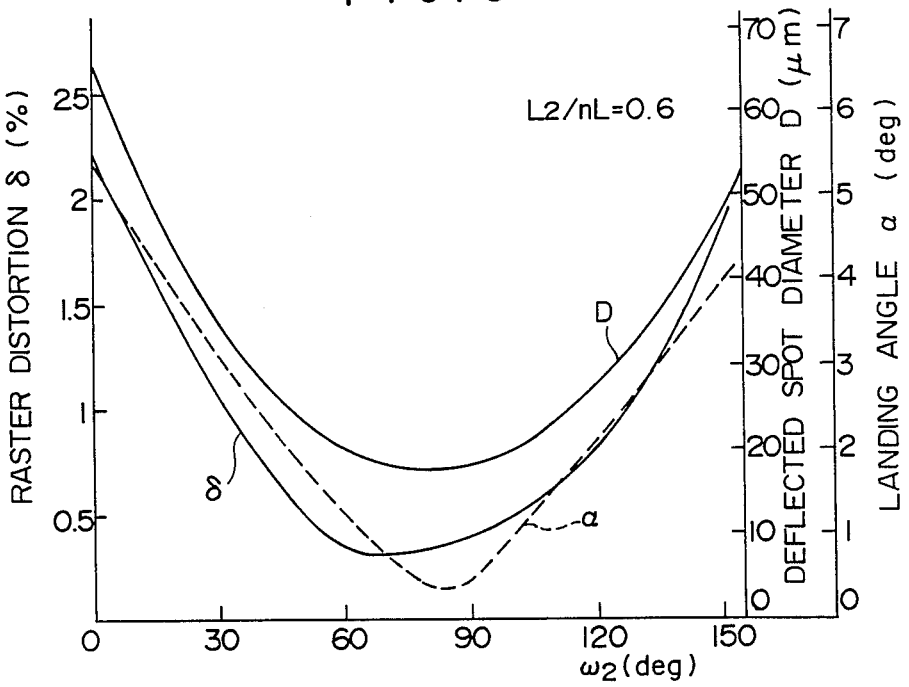

FIG. 5 shows the relationship between deflected beam characteristics with respect to the twist angle $\omega_2$ in the second region $L_2$, in the case where the division of the deflecting electrodes 5 into the first and the second region is set to $L_1/nL=0.6$. The twist angle in the first region $L_1$ is $\omega_1=0$. The $\omega_2$ giving the best values for various characteristics is about 80° for the landing angle $\alpha$; about 70° for the raster distortion $\delta$; and about 80° for the deflected spot diameter D. However, for the region, where the raster distortion $\delta$ is smaller than 0.5%, $\omega_2=50°$ to 100° is suitable.

Figure 6:
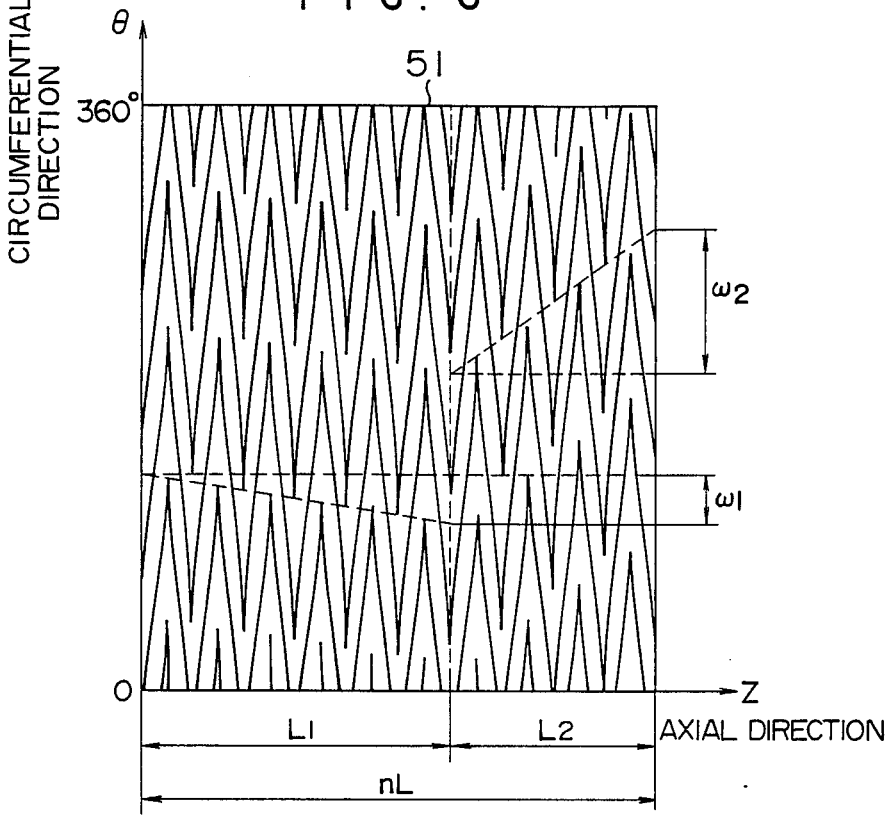
FIG. 6 is a developed view similar to FIG. 2A illustrating deflecting electrodes according to another embodiment of this invention.
Figure 7:
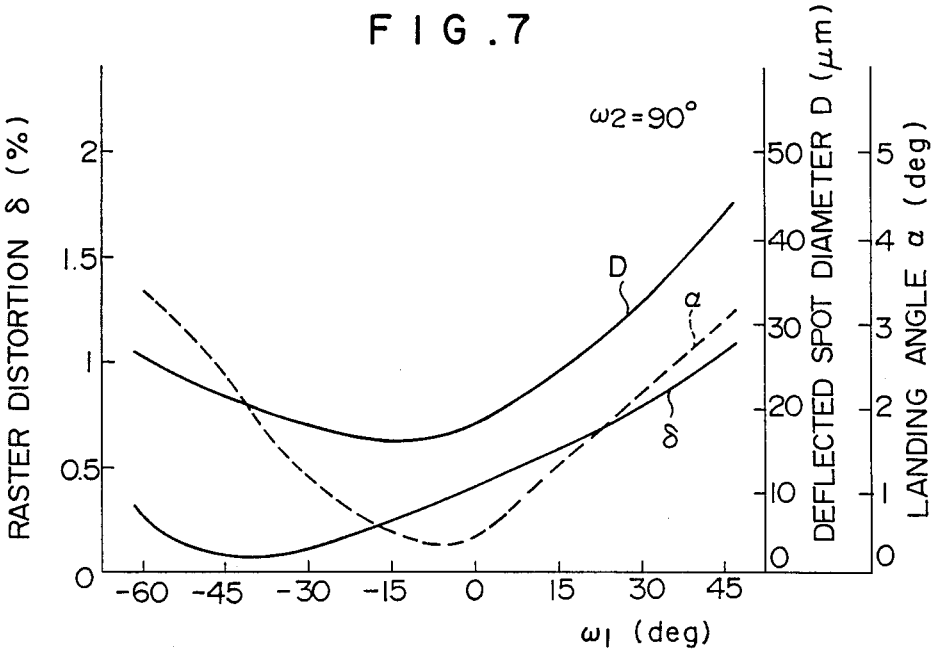
FIG. 7 is a graph showing deflection characteristics for the embodiment illustrated in FIG. 6.

FIG. 6 is a development scheme illustrating deflecting electrodes according to another embodiment of this invention. The deflecting electrodes 51 consist of the first region $L_1$ and the second region $L_2$. A negative twist angle $\omega_1$ is applied to the first region $L_1$ and a positive twist angle $\omega_2$ is applied to the second region $L_2$. In this case also the twist angle per unit length along the axis of the tube on both sides of the boundary between the first region $L_1$ and the second region $L_2$ differ from each other. FIG. 7 shows the relationship between various deflected beam characteristics with respect to the twist angle $\omega_1$ in the first region $L_1$, in the case where the division of the deflecting region is $L_1/nL=0.6$ and the twist angle in the second region is $\omega_2=90°$. When the twist angle $\omega_1$ is negative, produced deflecting electric fields have more appropriate distributions and the rastor distortion $\delta$ and the deflected spot diameter D are reduced. In this case the most suitable twist angle is $\omega_1=0°$ to $-45°$.

Table 1 shows suitable values for four different embodiments, when the deflecting electrodes indicated in FIGS. 3 and 4 are used. In Table 1 Embodiments 1, 2 and 3 correspond to FIG. 3 and Embodiment 4 to FIG. 6.

TABLE 1

| | Embodiment 1 | Embodiment 2 | Embodiment 3 | Embodiment 4 |
|---|---|---|---|---|
| Diameter of deflecting electrode 5 (mm) | 16 | 16 | 24 | 16 |
| Total length nL of deflecting electrodes (mm) | 45 | 45 | 60 | 45 |
| Length of focusing coil 6 (mm) | 39 | 35 | 56 | 34 |
| Center position $Z_C$ of focusing coil (mm) | 26 | 27 | 33 | 27 |
| Voltage $E_{C2}$ applied to second grid 73 (V) | 105 | 105 | 15 | 105 |
| Voltage $E_{C3}$ applied to deflecting electrodes 7 (V) | 105 | 125 | 300 | 125 |
| Voltage $E_{C4}$ applied to mesh electrode (V) | 340 | 340 | 900 | 340 |
| Ratio of length of first region to total length $L_1/nL$ | 0.6 | 0.5 | 0.6 | 0.5 |
| Twist angle $\omega_1$ in first region (degree) | 0 | 0 | 0 | −15 |
| Twist angle $\omega_2$ in second region (degree) | 60 | 63 | 83 | 70 |

Figure 8:
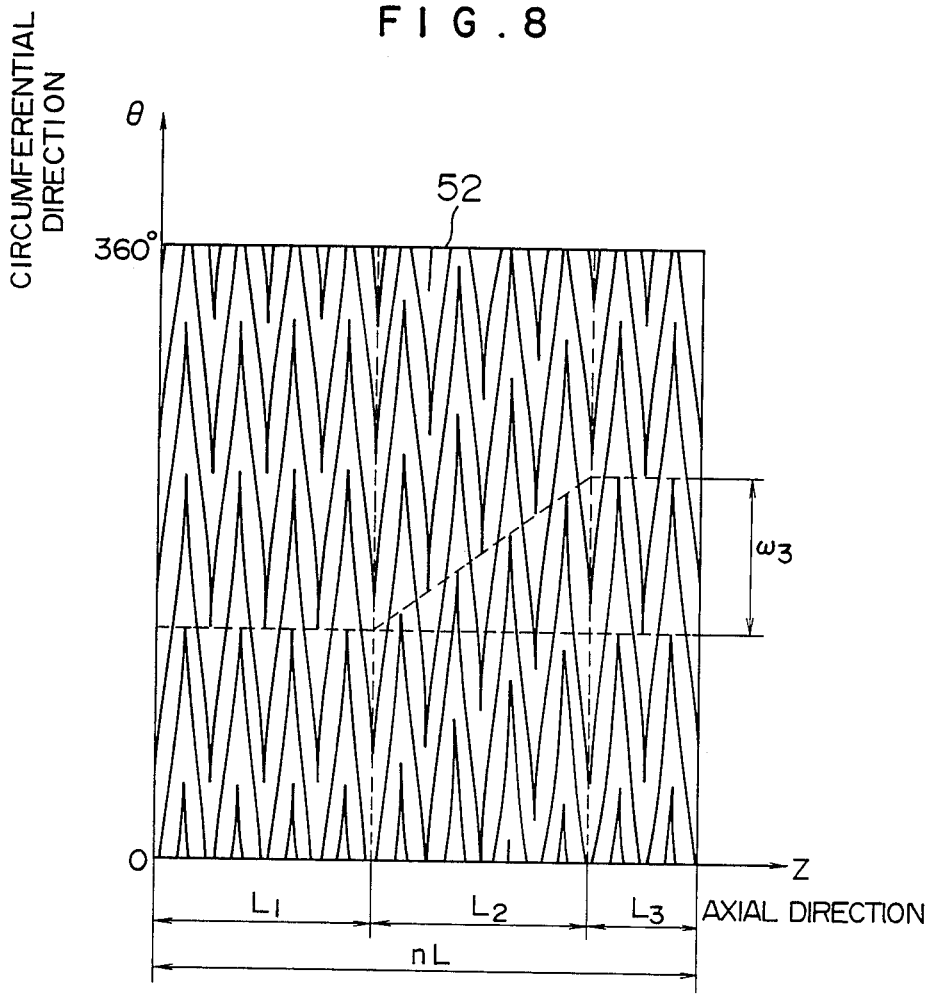
FIGS. 8 and 9 are developed views similar to FIG. 2A illustrating deflecting electrodes according to still other embodiments of this invention.

FIG. 8 is a development scheme illustrating deflecting electrodes according to another embodiment of this invention. The deflecting electrodes 52 consist of three regions, i.e. a first region $L_1$, a second region $L_2$ and a third region $L_3$. In this embodiment a twist angle is applied only to the second region $L_2$ and the deflecting electrodes are twisted neither in the first nor in the third region. In this case, the twist angle per unit length along the axis of the tube on both sides of the boundaries between the first region $L_1$ and the second region $L_2$ as well as between the second region $L_2$ and the third region $L_3$ differ from each other.

Figure 9:
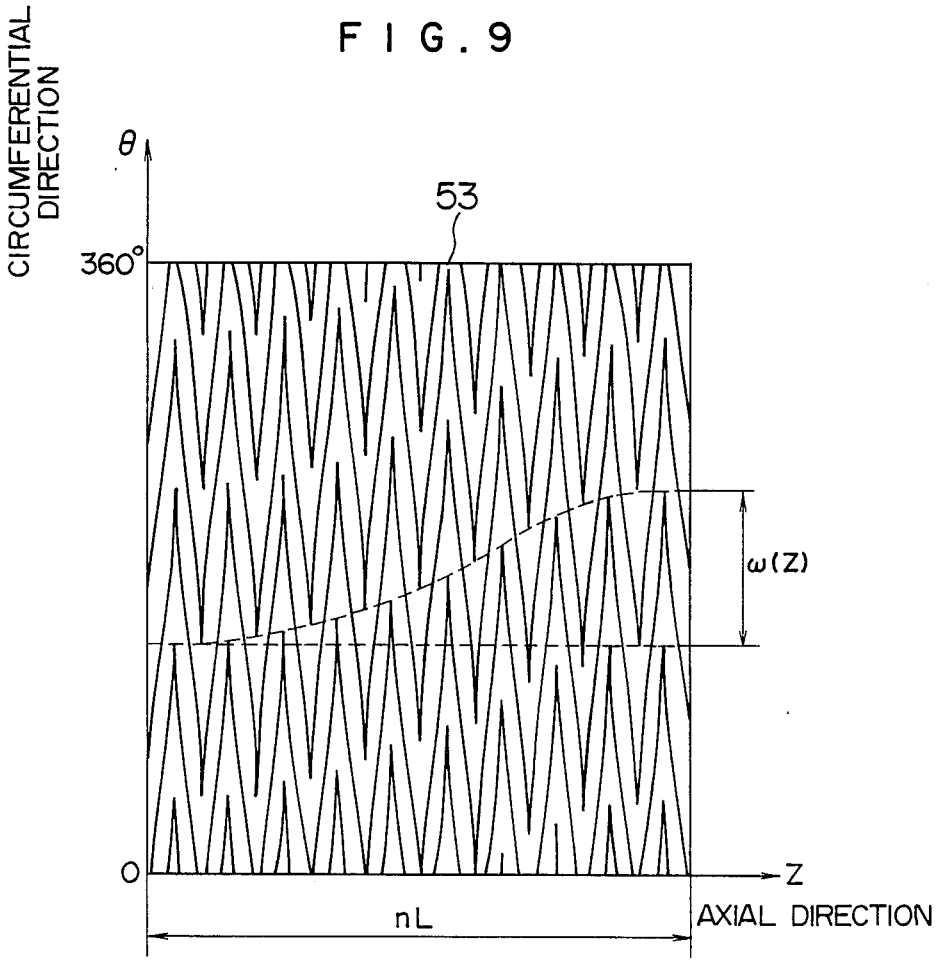

FIG. 9 is a development scheme illustrating deflecting electrodes according to still another embodiment of this invention. In the deflecting electrodes 53 the twist angle per unit length varies for every pitch and the twist angle per unit length is given by a function of the distance in the axial direction in accordance with the rotational movement of electrons, i.e. $\omega(Z)$ is set. In this case the twist angle per unit length is changing continuously along the total length of the deflecting electrodes 53.

We claim:

1. An image pick-up tube comprising:

a cylindrical envelope having an axis;

an electron gun disposed at one end of said envelope for producing an electron beam;

a target disposed on the other end of said envelope and scanned with said electron beam;

a focusing coil disposed around said envelope and producing a magnetic field for focusing said electron beam; and a plurality of deflecting electrodes disposed on the inner surface of said envelope between said electron gun and said target for deflecting said electron beam;

wherein said plurality of deflecting electrodes are zig-zag shaped and interleaved relative to each other, said zig-zag shaped deflecting electrodes being twisted about the axis of said envelope so that the circumferential twist angle, defined by the tips of the zig-zag shape of deflection electrodes about the axis of said envelope, varies along said axis as electrodes are twisted about said axis from one end of said deflecting electrodes to the other end of said deflecting electrodes.

2. An image pick-up tube according to claim 1, in which said deflecting electrodes comprise at least a first region and a second region from the electron gun side to said target side, only said second region having a twist angle which rotates in a direction as viewed from the target side.

3. An image pick-up tube according to claim 2, in which the tips in said first region have a twist angle per unit length rotating in a direction which is opposite to that of the twist angle per unit length of the tips in said second region.

4. An image pick-up tube according to claim 2, in which the twist angle of the tips in said second region is between 50° and 100°.

5. An image pick-up tube according to claim 3, in which the twist angle of the tips in said second region is between 50° and 100° and the twist angle of the tips in said first region is between 0° and 45°.

6. An image pick-up tube according to claim 2, in which the ratio of the length of said first region in the axial direction to the length of said deflecting electrodes in the axial direction is between 0.5 and 0.7.

7. An image pick-up tube according to claim 2, in which said deflecting electrodes are positioned in a first region, a second region and a third region from the electron gun side to the target side.

8. An image pick-up tube according to claim 1, in which said twist angle varies for every pitch of zig-zag shaped deflecting electrodes.

9. An image pick-up tube according to claim 1, further comprising a mesh electrode disposed between said deflecting electrodes and said target in which DC voltages applied to said deflecting electrodes are lower than 40% of the DC voltage applied to said mesh electrode.

10. An image pick-up tube according to claim 1, in which said deflecting electrodes comprise at least a first region and a second region from the electron gun side to said target side, only said second region having a twist angle which rotates in the counterclockwise direction as viewed exteriorly of the tube from the target side where the focusing magnetic field along the envelope axis is set to be N pole at said target side.

11. An image pick-up tube according to claim 10, in which the tips in said first region have a twist angle per unit axial length rotating in a direction which is opposite to that of the twist angle per unit axial length of the tips in said second region.

12. An image pick-up tube according to claim 10, in which the twist angle of the tips in said second region between 50° and 100°.

13. An image pick-up tube according to claim 10, in which the ratio of the length of said first region in the axial direction to the overall length of said deflecting electrodes in the axial direction is comprised between 0.5 and 0.7.

14. An image pick-up tube according to claim 10, in which said deflecting electrodes consist of a first region, a second region and a third region which has a different twist angle from the twist angle of the second region from the electron gun side to the target side.

15. An image pick-up tube comprising:

an electron gun disposed at one end of a glass tube for producing an electron beam;

a target disposed on the other end of the glass tube and scanned with said electron beam;

a focusing coil disposed around said glass tube and producing a magnetic field for focusing said electron beam; and a plurality of deflecting electrodes disposed on the inner surface of said glass tube between said electron gun and said target for deflecting said electron beam;

wherein each of said deflecting electrodes is disposed in a zig-zag shape from one end to the other and each of said deflecting electrodes has a twist with a twist angle formed by a first line ($OB_1$) and a second line ($OB_2$) where the point O is the axis of the glass tube seen from said electron gun, and the points $B_1$ and $B_2$ are two ends of a line connecting upper apices of the zig-zag shape from one end to the other end of the deflecting electrodes seen from said electron gun, respectively, twist angle varies in a non-linear fashion along the axial direction of the glass tube.

16. An image pick-up tube according to claim 15, in which said deflecting electrodes comprise at least a first region closest to the electron gun side and a second region closet to the target side, only the electrodes in said second region having a twist angle which rotates clockwise as viewed from the position of the electron gun with respect to the direction of the magnetic field.

17. An image pick-up tube according to claim 15, in which said twist angle varies for every pitch of said zig-zag shaped deflecting electrodes.

18. An image pick-up tube comprising:

a cylindrical envelope having an axis;

an electron gun disposed at one end of said envelope for producing an electron beam;

a target disposed on the other end of said envelope and adapted to be scanned with said electron beam;

a focusing coil disposed around said envelope tube for producing a magnetic field that focuses said electron beam; and a plurality of deflecting electrodes disposed on the inner surface of said envelope between said electron gun and said target for deflecting said electron beam;

said deflecting electrodes having zig-zag shaped elements interleaved with respect to each other along the axis of said envelope and tips about the circumference of said elements, said deflecting electrodes being formed so that a first line along adjacent tips about the axis of said envelope on one side of an intermediate tip is not parallel to a second line along adjacent tips about the axis of said envelope on the side opposite to said one side of said intermediate tip.

19. An image pick-up tube according to claim 18, wherein said deflecting electrodes include a first region comprising said one side of said intermediate tip, and a second region comprising said opposite side of said intermediate tip, said first region faces the electron gun, and said second region faces said target, said first line passes through a plurality of tips in said first region and said second line passes through a plurality of tips in said second region.

20. An image pick-up tube according to claim 19, wherein said first line is substantially parallel to said envelope axis and said second line forms an angle with said envelope axis of between about 50° and 100°.

21. An image pick-up tube according to claim 20, wherein the ratio of the length of said first region to the total length of the deflecting electrodes in the axial direction is between about 0.5 and 0.7.

22. An image pick-up tube comprising:

an electron gun disposed at one end of a glass tube for producing an electron beam;

a target disposed on the other end of the glass tube and scanned with said electron beam;

a focusing coil disposed around said glass tube and producing a magnetic field for focusing said electron beam; and a plurality of deflecting electrodes disposed on the inner surface of said glass tube between said electron gun and said target for deflecting said electron beam;

wherein each of said deflecting electrodes is disposed in a zig-zag shape from one end to the other and each of said deflecting electrodes has a twist with a twist angle formed by a first line ($OB_1$) and a second line ($OB_2$) where the point $O_1$ is the axial point on the cross section at the end of said deflection electrode near the said electron gun, and $O_2$ is the axial point on the cross section and the points $B_1$ and $B_2$ are two ends near said target of line connecting upper apices of the zig-zag shape from one end to the other end of the deflecting electrodes seen from said electron gun, respectively, twist angle varies in a non-linear fashion along the axial direction of the glass tube.

* * * * *